United States Patent [19]

Ritter

[11] Patent Number: 4,470,727

[45] Date of Patent: Sep. 11, 1984

[54] APPARATUS AND PROCESS FOR FOAMED CEMENTING

[75] Inventor: James C. Ritter, Tulsa, Okla.

[73] Assignee: The Dow Chemical Company, Midland, Mich.

[21] Appl. No.: 368,615

[22] Filed: Apr. 15, 1982

[51] Int. Cl.[3] ..... E02D 29/00

[52] U.S. Cl. ..... 405/267; 166/305 R; 405/258; 405/263; 406/46; 406/197

[58] Field of Search ..... 406/197, 46, 49, 181, 406/183; 166/90, 91, 305 R, 309; 405/258, 263, 267

[56] References Cited

U.S. PATENT DOCUMENTS 3,833,718 9/1974 Reed et al. ..... 166/305 R

FOREIGN PATENT DOCUMENTS 819229 9/1959 United Kingdom ..... 406/46

OTHER PUBLICATIONS

V. P. Detkov and A. K. Sabirzyanov, "The Use of Aerated Cement Slurries for Well Cementing," Neft. Khoz., 1976, No. 5, 16–20.

*Primary Examiner*—Jeffrey V. Nase
*Assistant Examiner*—Daniel R. Edelbrock

[57] ABSTRACT

Process and apparatus for preparing a substantially uniform, gas-containing cement slurry by directing two pressurized streams of a gas-containing hydraulic cement slurry to a common in-line focal point in a generally opposed fashion so that good mixing is achieved by the contact of the two streams. The process is particularly adapted for use in preparing "foamed" cement slurries for cementing subterranean voids such as well boreholes, groutholes, natural cavities and similar voids.

6 Claims, 3 Drawing Figures

APPARATUS AND PROCESS FOR FOAMED CEMENTING

BACKGROUND OF THE INVENTION

The invention pertains to cementing with a gas-containing cement slurry, more particularly, it pertains to cementing a void in a subterranean formation. Commonly such voids are created or encountered in the drilling of boreholes in the production of oil or gas or of geothermal fluids from the earth. The invention is especially adapted to the use of "foamed" cements in the completion of such wells at great depths or in weak subterranean formations which are easily fractured by cement slurries of ordinary weights.

Traditionally, cement slurries for use in such applications have been prepared by blending dry cement and additives with water and liquid additives in mixing tanks employing mechanical agitation to achieve relatively homogeneous slurries. Aerated or gasified (i.e. "foamed") cement slurries have been prepared for surface applications by addition of a foaming agent or air entraining agent to the mixing tank. For use in subterranean foamed cement applications, the cement slurry has been prepared in the traditional fashion, a foaming agent has been subsequently added to the slurry at a point downstream from the mixing tank, and air (or gas such as nitrogen) has then been added to the slurry at a point further downstream prior to introduction of the slurry into the subterranean formation. Mixing of the gas so added has been achieved through the turbulence created by the flow of the slurry in the conduit or from the energy of the gas itself. Such turbulence has been created by the injection of air, under pressure, at an angle substantially normal to the flow of cement slurry in the conduit through a "tee" or a "y" in the conduit; British Pat. 819,229.

However, these methods of adding a gas to a cement slurry have not always resulted in a uniform mixture of gas and slurry. When a well is being cemented which does not have a positive backpressure, the foamed cement prepared may not be a uniform mixture of gas and slurry since accurate regulation of the liquid and gaseous components is difficult to achieve.

Chokes have been widely used in the oilfield to control the flow rate of high pressure fluids issuing from wells. These chokes are usually centered in a flow line so that the fluid's velocity decays to a point where the fluid emitted no longer erodes the wall of the piping. A system of opposed chokes, similar to that described herein, has been used to depressurize oilfield fluids, as described in copending U.S. application Ser. No. 185,087 filed Sept. 8, 1980, by Warren M. Zingg et al.

SUMMARY OF THE INVENTION

A process for preparing a substantially uniform, gas-containing cement slurry by:

(a) delivering to a point enclosed within a collection chamber a gas-containing, hydraulic cement slurry in two pressurized, substantially monodirectional, opposed streams of generally equal and opposite force; and (b) withdrawing the resulting substantially uniform, gas-containing cement slurry from the collection chamber;

wherein said point is a common focal point for the major force vector of each stream. In this fashion, extremely good mixing of the hydraulic cement slurry occurs and the gas contained therein is homogeneously distributed throughout the slurry as discrete bubbles of very small, substantially uniform diameter. Thus, a foamed cement may be prepared having, when set, extremely low permeability to fluids. This makes it useful for the purpose of cementing voids in subterrannean formations such as are encountered in the drilling or completion of oil, gas or geothermal wellbores. Slurry of such a uniform foam of small bubble size has the additional advantage over prior foamed slurries of emplacement in subterannean voids without separation of the gaseous component from the liquid and solid components of said slurry. The process is also useful for preparing foamed cement slurries for emplacement in building construction on the earth's surface.

DETAILED DESCRIPTION OF THE INVENTION

The process of the invention may be carried out by preparing an aqueous, hydraulic cement slurry with any one of a number of commercially utilized cement mixing devices. These include a stirred blending tank, a venturi jet mixer and the well known rotating cement mixer trucks commonly seen in day to day construction work. The means for preparing the slurry is not a critical element of the instant invention.

Figure 1:
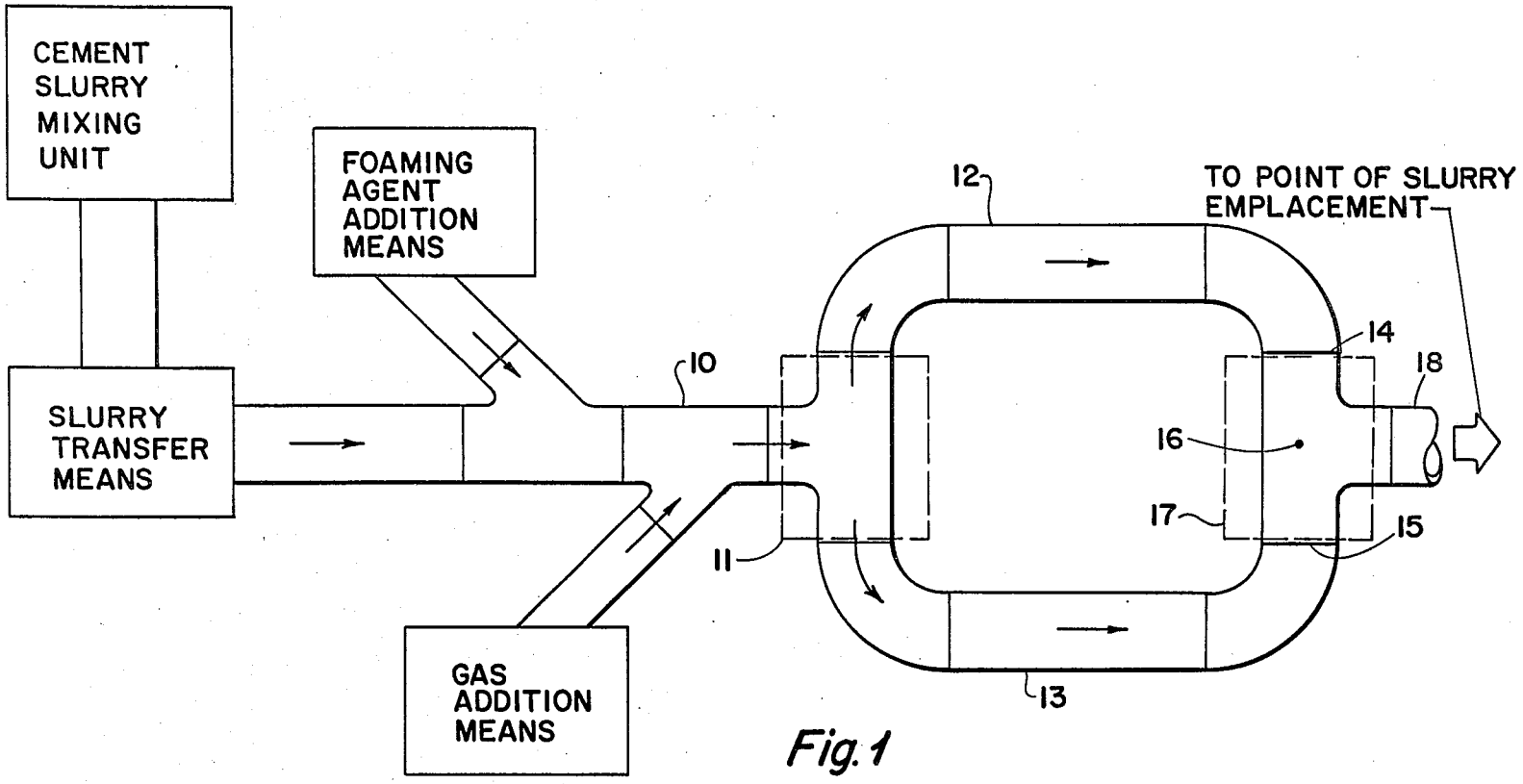
FIG. 1 is a schematic drawing of an equipment and piping arrangement useful for practicing the invention.

Once the slurry is prepared, it is moved by a transfer means into a first enclosed conduit. The slurry transfer means can be a common hydraulic pump such as a triple cylinder positive displacement pump commonly known as a "triplex" pump. This pump is widely used in the oilfield. The transfer means is not critical as long as it has the ability to transport a liquid/solid slurry with suitable velocity and a centrifugal pump may likewise be employed for this purpose. The slurry transfer means is used to transport the slurry through a first enclosed conduit which is represented in FIG. 1 by the numeral 10. This conduit may be a standard length of piping which can be attached to the slurry transfer means by employing standard connections and piping utilized in treating oil wells.

To the slurry in the conduit is added a foaming agent which may be any suitable surfactant commonly employed for the generation and stabilization of foams. Such surfactant may be selected from nonionic, anionic and cationic surfactants of which a wide assortment is available. Injection into the slurry-carrying conduit may be accomplished with any suitable transfer means such as a small liquid blending pump which may be attached to the conduit by a "tee" connection or a "y-bend" connection suitably attached to the conduit. It is not advisable to add the foaming agent to the slurry upstream from a slurry transfer means such as a triplex pump. To do so may cause gas to be entrained in the slurry making it difficult for all but specially designed pumps to handle such a foamed mixture. This causes problems which can be avoided by adding the foaming agent downstream from the transfer means.

To the conduit containing the slurry is also added a gas in suitable quantities and at a suitable rate to obtain a gas-containing cement slurry of the gas:cement slurry proportions desired for the intended application. Ordinarily, for oilfield applications, sufficient gas would be added to obtain a resulting gas-containing slurry of a density of about five pounds per gallon or greater. The gas to be added may be any gas readily available. For ease and convenience, air, nitrogen or carbon dioxide may be selected. Flammable gases are generally to be avoided because of the hazard they present. Alternatively, a gas generating agent may be added to the cement slurry to form the gas in situ. Metallic aluminum or magnesium powder are such gas generating agents which have previously been employed in oilwell cementing. However, because of the explosive nature of the hydrogen generated in such an application, other inert gas generating agents (such as have been employed in the plastic foam-blowing art) are preferred to such metals. FIG. 1 shows schematically a representation of the addition of the foaming agent and the gas to the cement slurry in conduit 10.

Subsequent to the addition of the foaming agent and the gas, the gas-containing slurry in conduit 10 is contacted with a means for dividing the gas-containing slurry into two generally equal streams. This dividing means is represented in FIG. 1 by the "tee-joint"piping assembly 11. Similarly, a "y-bend" in the piping may be employed for this purpose of dividing the slurry of conduit 10 into generally equal streams.

This dividing means for the cement slurry is in fluid communication with a second and third enclosed conduit represented by 12 and 13 which serve to convey the two streams of slurry to a first and second pressure control device represented by 14 and 15. The devices each have an orifice which orifices are spaced from each other and in direct opposite alignment with one another. These pressure control devices are adapted to deliver the gas-containing slurry in two pressurized streams of generally equal force to a common, in-line focal point which is represented by 16. This focal point is enclosed in a collection chamber represented by 17 from which the resulting substantially uniform, gas-containing cement slurry is then withdrawn to the desired point of slurry emplacement by a conduit, represented by 18, or other means.

The pressure control devices represented by 14 and 15 are suitably the orifices formed by the ends of two opposed pieces of piping directed at the common focal point 16 in a collection chamber which is represented by the simple "tee-joint" in 17 in FIG. 1. Alternatively, when the diameters of the conduits 12 and 13 are sufficiently large that no significant pressure drop occurs across their respective orifices, a flow restricting device may be placed in the conduits at 14 and 15 to create a pressure drop sufficient to impart a significant force to the two streams of slurry. This allows the two streams to come into contact with significant force and thereby achieve good mixing and shearing of the slurry about the point of contact 16 in the collection chamber 17.

Figure 2:
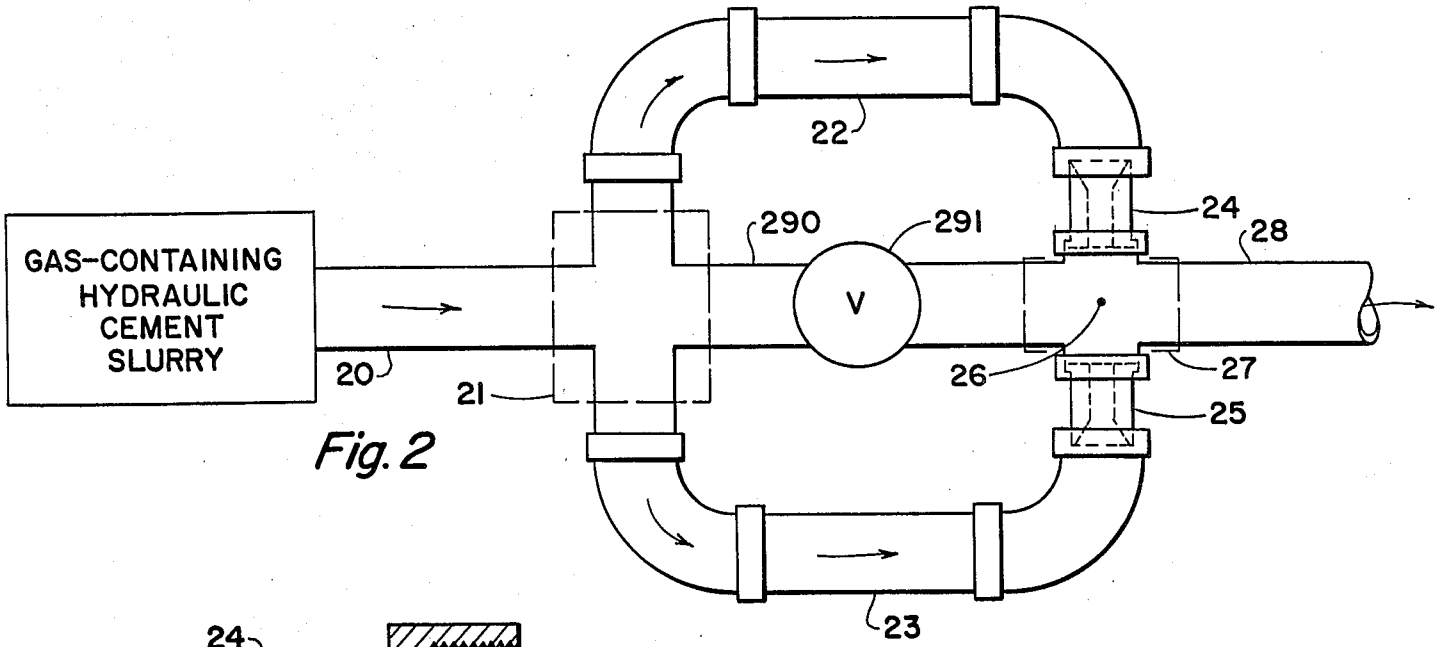
FIG. 2 is a diagram of a preferred piping assembly which permits the pressure control devices of the apparatus to be bypassed when desired.

While FIG. 1 and FIG. 2 show the assembly as a loop-shaped device having a common source of slurry, it will be readily apparent to the artisan that more than one source of slurry could be fed into the "loop" or, the loop could be severed such that each of the pressure control orifices would be emitting pressurized slurry streams derived from separate sources.

In FIG. 2, a preferred embodiment of the "loop" assembly is shown where the gas-containing cement slurry is conveyed by the first enclosed conduit 20 to a dividing means represented by 21 which instead of a "tee-joint" or "y-bend" is represented instead by a four-way crossover. One arm of the crossover is adapted to receive the slurry from 20, two arms are adapted to divide the slurry into two generally equal streams and communicate these streams to the second and third enclosed conduits represented by 22 and 23. The fourth arm is adapted to permit the slurry to continue passage in a substantially direct line to the collection chamber, or to a point downstream from the collection chamber, through the enclosed conduit represented by 290 and a valve represented by 291 when said valve is in an open position.

Figure 3:
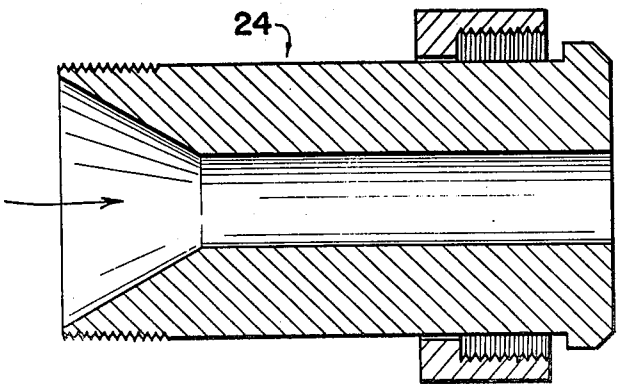
FIG. 3 is an enlarged cross-sectional drawing of a flow bean which is a pressure restriction device utilized in the mixing apparatus in a preferred embodiment of the invention.

When valve 291 is in a closed position, the apparatus in FIG. 2 will operate in exactly the same fashion as the apparatus in FIG. 1. The two streams of slurry will then flow through conduits 22 and 23, to be directed to a common focal point at 26 in the collection chamber represented by 27 by the orifices of 24 and 25. The pressure control devices represented by 24 and 25 are flow beans. A flow bean is a common flow restricting device adapted for incorporation as a segment of piping and which is commonly employed in oilfield operations. An enlarged cross section representation of such a flow bean is found in FIG. 3.

The preferred apparatus of FIG. 2 has an advantage over that of FIG. 1 in that fluids may be pumped directly through conduit 290 when valve 291 is in an open position thereby avoiding significant flow of fluid through conduits 22 and 23. This can be particularly advantageous in oilfield cementing since shear sensitive fluids such as gelled spacers or drilling muds may be pumped ahead of or behind the cement slurry. Also, standard cement slurries not containing any gas may be pumped ahead of or behind the foamed cement slurry as lead-in or tail-in slurries when cementing subterranean voids. Since the use of multiple fluids is common in oilfield cementing applications, the preferred apparatus of FIG. 2 is especially adapted for such use.

The apparatus of FIG. 2 is also usefully employed in the emplacement of foamed cement slurries in surface applications. By suitably sizing the conduits 22, 23 and 290, flow of slurry through all three conduits may be accomplished by commencing pumping with valve 291 closed and then subsequently slowly opening 291 to achieve a head of pressure across point 26. In this fashion, foamed cement slurry is discharged from 28 with substantial velocity which may aid in the emplacement of such a slurry in hard to reach positions such as in vertical forms used for forming walls or other architectural structures.

In oilfield applications, it will not generally be necessary to have a variable valve at 291. A simple flow through ball valve which is selectively either in an open or closed position may suitably be employed in such applications.

The materials of construction can be varied to convenience so long as due regard is given to the pressure limitations to which the particular apparatus will be exposed. Steel is the most conventional material of construction and is, therefore, preferably employed. Standard gauge oilfield treating pipes and connections may suitably be employed to assemble the apparatus described in the drawings.

Embodiment

The following example will further illustrate the invention.

An assembly as described herein and illustrated by FIG. 2 was employed to cement a five and one-half inch casing to a depth of about 8300 feet in a borehole previously drilled. About fifty barrels of a gelled spacer were first pumped with the valve 291 in an open position, followed by about 30 barrels of an aqueous surfactant wash solution, which was then followed by about 24 barrels of 35:65 pozzolan:class G cement lead-in slurry of a density of about 14 pounds per gallon. This was followed, with valve 291 closed, by about 370 barrels of a 35:65 pozzolan: class G slurry containing about 1.5 percent (vol.) foaming agent and about 125,000 standard cubic feet of nitrogen. This foamed cement slurry had a density of about ten and one-half pounds per gallon at standard conditions. The valve was again opened and about 90 barrels of a 35:65 pozzolan:class G tail-in slurry having a density of about 15 pounds per gallon and followed by about 190 barrels of salt water were pumped until returns of the spacer and chemical wash were seen. The well then was shut in and the cement permitted to set up. In this fashion, this "long string" casing job was completed in one single pumping operation without having to "stage" the different cement slurries over the desired interval.

I claim:

1. A process for preparing a substantially uniform, gas-containing cement slurry and for emplacing same in a subterranean void either before or after the transport to or through said void of a fluid other than said gas-containing cement slurry comprising (a) preparing an aqueous, hydraulic cement slurry;

(b) transporting said aqueous, hydraulic cement slurry through a first enclosed conduit;

(c) introducing into said first enclosed conduit a foaming agent and a gas to form a gas-containing, hydraulic cement slurry;

(d) thereafter contacting said gas-containing slurry from said first conduit with a means for dividing the gas-containing hydraulic cement slurry into two generally equal streams;

(e) flowing one stream into a second separate, enclosed conduit and the other stream into a third separate, enclosed conduit;

(f) directing one stream to a first pressure control device and the other stream to a second pressure control device wherein each pressure control device has an orifice, said orifices are spaced from each other and in direct alignment with each other, each pressure control device is adapted to deliver the gas-containing hydraulic cement slurry in a pressurized stream of generally equal force to a common, in-line focal point and the focal point is enclosed in a collection chamber from which the resulting substantially uniform, gas-containing cement slurry is withdrawn;

(g) emplacing the resulting gas-containing cement slurry in a subterranean void subsequent to withdrawal from the collection chamber and permitting it to harden in said void; and (h) transporting to or through said void, either before or after the gas-containing cement slurry, a fluid other than said slurry by diverting same from said first conduit to the collection chamber, or to a point downstream from said collection chamber, through a fluid diverting means which is in direct fluid communication with said first conduit and with the collection chamber or a point in the flow path of the gas-containing cement slurry downstream from the collection chamber and thereafter directing said other fluid to or through said subterranean void.

2. The process of claim 1 wherein the fluid diverting means comprises a valve in fluid communication, via a fourth enclosed conduit, with said first enclosed conduit and said collection chamber.

3. The process of claim 1 or 2 wherein the fluid is non-gasified hydraulic cement slurry.

4. The process of claim 1 wherein the pressure control devices are flow restriction means located in said second and third enclosed conduits.

5. The process of claim 4 wherein the pressure control devices are flow beans.

6. An apparatus useful for preparing a substantially uniform, gas-containing cement slurry comprising:

(a) a first enclosed conduit adapted to transport a gas-containing, hydraulic cement slurry, in fluid communication with (b) a means for dividing such a slurry into two generally equal streams, in fluid communication with (c) a second enclosed conduit and a third enclosed conduit, both adapted to transport separately the two streams of such a slurry to a first and second pressure control device, (d) a collection chamber in fluid communication with both pressure control devices and with (e) a means for withdrawing the resulting slurry, formed by recombination of the two streams, from the collection chamber and (f) a fluid diverting means which is in fluid communication with the first enclosed conduit (a) and with the collection chamber (d) and which comprises a fourth enclosed conduit and a valve in fluid communication therewith which valve is adapted to allow or restrict fluid flow through said fourth conduit;

wherein each pressure control device is in fluid communication with its respective enclosed conduit and has an orifice which is spaced from the other orifice and in direct, co-axial opposite alignment with the other orifice, and each is adapted to deliver fluid from its respective orifice in a pressurized stream of generally equal force to a common, in-line focal point located in said collection chamber (d).

* * * * *